US009982929B2

(12) United States Patent
Takeichi

(10) Patent No.: US 9,982,929 B2
(45) Date of Patent: May 29, 2018

(54) AIR CONDITIONER

(71) Applicant: SAMSUNG ELECTRONICS CO., LTD., Suwon-si, Gyeonggi-do (KR)

(72) Inventor: Hisashi Takeichi, Osaka (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 809 days.

(21) Appl. No.: 14/077,849

(22) Filed: Nov. 12, 2013

(65) Prior Publication Data

US 2014/0137588 A1 May 22, 2014

(30) Foreign Application Priority Data

Nov. 20, 2012 (JP) ..... 2012-254434
Oct. 31, 2013 (KR) ..... 10-2013-0131309

(51) Int. Cl.
*F25B 49/02* (2006.01)
*F25B 13/00* (2006.01)
*F25B 31/00* (2006.01)

(52) U.S. Cl.
CPC ..... *F25B 49/022* (2013.01); *F25B 13/00* (2013.01); *F25B 31/006* (2013.01); *F25B 2313/02741* (2013.01); *F25B 2600/2509* (2013.01)

(58) Field of Classification Search
CPC ..... F25B 2400/072; F25B 2400/054; F25B 13/00; B60H 1/00271
See application file for complete search history.

(56) References Cited

U.S. PATENT DOCUMENTS 1,497,615 A * 6/1924 Thompson ..... C09K 5/042 252/67
1,864,608 A * 6/1932 Munters ..... F25B 19/00 123/41.19

(Continued)

FOREIGN PATENT DOCUMENTS

CN 101031763 9/2007
CN 101688711 3/2010

(Continued)

OTHER PUBLICATIONS

Chinese Office Action dated May 27, 2017 in related Chinese Application No. 201310585957.2.

(Continued)

*Primary Examiner* — Ljiljana Ciric
*Assistant Examiner* — Alexis Cox
(74) *Attorney, Agent, or Firm* — Staas & Halsey LLP

(57) ABSTRACT

An air conditioner includes a main refrigerant circuit where refrigerant flows in order of a compressor, outdoor heat exchanger, expansion valve, and indoor heat exchanger. An injection circuit is configured such that the refrigerant diverges between the outdoor heat exchanger and indoor heat exchanger in the main refrigerant circuit and returns to the compressor having a pressure between a suction pressure of compressor and a discharge pressure of compressor. The injection circuit includes an injection decompression valve reducing a pressure of the refrigerant, a control unit cooling portion cooling a control unit to control the compressor using the refrigerant, and a sub-cooler evaporation portion provided at a downstream side of the injection decompression valve such that heat exchange of the refrigerant is performed in the sub-cooler evaporation portion, and the control unit cooling portion is provided between the injec- (Continued)

tion decompression valve and the sub-cooler evaporation portion in the injection circuit.

6 Claims, 7 Drawing Sheets

(56) References Cited

U.S. PATENT DOCUMENTS 5,647,224 A * 7/1997 Kushiro ..... C09K 5/045 62/114
6,293,108 B1 * 9/2001 Cho ..... F25B 6/04 62/5
7,729,117 B2 * 6/2010 Schweinbenz ..... H05K 7/20872 165/104.19
2004/0069481 A1 * 4/2004 Ebara ..... B60H 1/00907 165/202
2006/0032267 A1 * 2/2006 Kamimura ..... F25B 1/10 62/498
2006/0080989 A1 * 4/2006 Aoki ..... F25B 40/00 62/324.4
2006/0266063 A1 * 11/2006 Groll ..... F25B 1/10 62/228.5
2009/0241569 A1 * 10/2009 Okada ..... F25B 40/00 62/196.1
2012/0180510 A1 * 7/2012 Okazaki ..... F25B 13/00 62/218
2012/0255318 A1 10/2012 Kido et al.

FOREIGN PATENT DOCUMENTS

CN 102667368 9/2012
JP 2010-2112 1/2010
JP 2011179783 9/2011

OTHER PUBLICATIONS

Communication under Rule 71(3) EPC dated May 8, 2017 in related European Application No. 13 193 260.0.
Chinese Decision on Grant dated Feb. 5, 2018 in related Chinese Application No. 201310585957.2.

* cited by examiner

AIR CONDITIONER

CROSS-REFERENCE TO RELATED APPLICATIONS

This application claims the benefit of Japanese Patent Application No. 2012-254434, filed on Nov. 20, 2012 in the Japanese Patent Office, and Korean Patent Application No. 10-2013-0131309, filed on Oct. 31, 2013 in Korean Intellectual Property Office, the disclosures of which are incorporated herein by reference.

BACKGROUND

1. Field

Embodiments of the present disclosure relate to an air conditioner having a control unit cooling portion which cools a control unit to control a compressor using a refrigerant.

2. Description of the Related Art

In a conventional refrigeration device, a control unit cooling portion which cools a control unit to control a compressor using a refrigerant is installed to a main refrigerant circuit configuring a series of refrigeration cycles. Therefore, there is a problem in that, at low differential pressure when the refrigeration cycles are activated, a flow rate of a refrigerant to cool the control unit is not secured in the control unit cooling portion and thus the control unit is excessively heated.

In addition, in a conventional structure of providing the control unit cooling portion in the main refrigerant circuit, there is a problem in that the control unit is insufficiently cooled when a flow rate of the refrigerant within the main refrigerant circuit needs to be reduced due to oil foaming or the like in which lubricant is brought to an indoor unit in quantity. Thus, it is undesirable to install the control unit cooling portion to the main refrigerant circuit configuring a series of refrigeration cycles so as to cool the control unit.

Meanwhile, as the related art intended to improve efficiency of the refrigeration cycles, aside from the main refrigerant circuit, a refrigeration device is already known in which an injection circuit diverging from the main refrigerant circuit is formed. For example, see Japanese Patent Publication No. 2010-2112. In the refrigeration device disclosed in Japanese Patent Publication No. 2010-2112, an inverter cooling portion as the control unit cooling portion is provided within the injection circuit. Accordingly, a portion of a refrigerant diverging from the main refrigerant circuit is introduced through an expansion valve into the inverter cooling portion, and an inverter device, which is a type of the control unit, is cooled by the introduced refrigerant (see FIG. 1 in Japanese Patent Publication No. 2010-2112).

However, in the technique disclosed in Japanese Patent Publication No. 2010-2112, since the inverter device, which is a type of control unit, is insufficiently cooled, desired cooling efficiency may not be obtained. This is because the refrigerant introduced into the inverter cooling portion may not be maintained to a state suitable for cooling in the configuration of the refrigeration device in Japanese Patent Publication No. 2010-2112.

SUMMARY

Therefore, the present disclosure has been made in view of the above-mentioned problems and an aspect thereof is to provide an air conditioner capable of sufficiently cooling a control unit, compared with the related art.

Additional aspects of the disclosure will be set forth in part in the description which follows and, in part, will be apparent from the description, or may be learned by practice of the disclosure.

In accordance with one aspect of the present disclosure, an air conditioner includes a main refrigerant circuit configured such that a refrigerant flows in order of a compressor, an outdoor heat exchanger, an expansion valve, and an indoor heat exchanger, and an injection circuit configured such that the refrigerant diverges between the outdoor heat exchanger and indoor heat exchanger in the main refrigerant circuit and returns to the compressor in a state of having a pressure between a suction pressure and a discharge pressure, wherein the injection circuit includes an injection decompression valve reducing a pressure of the refrigerant, a control unit cooling portion cooling a control unit to control the compressor using the refrigerant, and a sub-cooler evaporation portion provided at a downstream side of the injection decompression valve such that heat exchange of the refrigerant is performed in the sub-cooler evaporation portion, and the control unit cooling portion is provided between the injection decompression valve and the sub-cooler evaporation portion in the injection circuit.

In accordance with such a configuration, since the control unit cooling portion is provided between the injection decompression valve and the sub-cooler evaporation portion in the injection circuit, the refrigerant supplied through the injection decompression valve to the control unit cooling portion may be in a liquid-rich state in which the refrigerant is not nearly vaporized. Accordingly, the control unit may be efficiently cooled by liquid cooling.

In other words, compared with a case of cooling the control unit using the refrigerant in a vaporized state as disclosed in Japanese Patent Publication No. 2010-2112, heat conduction efficiency from the control unit to the refrigerant may be improved according to the present disclosure. As a result, it may be possible to deprive the control unit of a maximum quantity of heat per unit time, and thus to efficiently cool the control unit.

In addition, in order to improve compression efficiency of the compressor, the refrigerant is preferably introduced into the compressor in a vaporized state to the utmost. In the present disclosure, as described above, by cooling the control unit using the refrigerant in a liquid-rich state, it may be possible to deprive the control unit of much heat. Consequently, the refrigerant may be farther vaporized than that of the related art by heat exchange in the sub-cooler evaporation portion. Accordingly, the refrigerant may be introduced into the compressor in a farther vaporized state than the related art. Thus, it may be possible to efficiently cool the control unit and to improve compression efficiency of the compressor.

Furthermore, the cooling efficiency of the control unit may be increased, and thus required cooling efficiency may be obtained even when the control unit cooling portion is minimized and a heat radiation area is small, compared with the related art, thereby enabling the volume of the outdoor unit to be minimized.

In order to freely adjust the refrigerant temperature in the control unit cooling portion by suitably adjusting design parameters such as a diameter of a throttle pipe, the injection circuit may further include a throttle pipe provided between the control unit cooling portion and the sub-cooler evaporation portion.

In order to prevent the temperature of the control unit from falling below a dew-point temperature and to securely prevent breakdown of the control unit caused by generation of dew condensation on the control unit, the air conditioner may include an outdoor air temperature sensor capable of detecting an outdoor air temperature, a control unit temperature detection portion capable of detecting a temperature of the control unit, a dew-point temperature calculation portion calculating a dew-point temperature at which dew condensation is generated on the control unit, based on the outdoor air temperature, and an opening degree adjustment portion adjusting an opening degree of the injection decompression valve such that the temperature of the control unit is equal to or more than the dew-point temperature.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
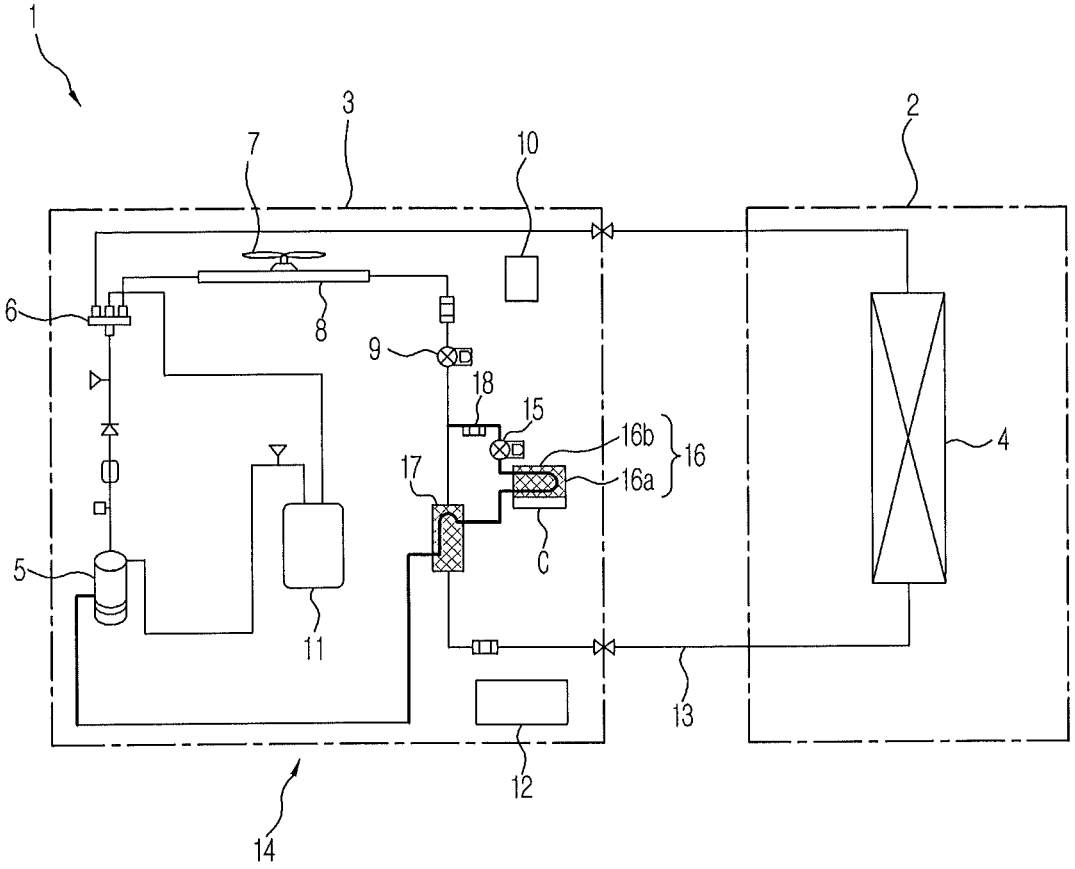
FIG. 1 is a diagram illustrating a configuration example of an air conditioner according to a first embodiment of the present disclosure.

Reference will now be made in detail to the embodiments, examples of which are illustrated in the accompanying drawings, wherein like reference numerals refer to the like elements throughout. The embodiments are described below to explain the present disclosure by referring to the figures.

First Embodiment

Hereinafter, an air conditioner 1 according to a first embodiment of the present disclosure will be described with reference to FIGS. 1 to 3.

[Configuration of Air Conditioner 1]

FIG. 1 illustrates a configuration example of an air conditioner 1 according to a first embodiment of the present disclosure. The air conditioner 1 is an air conditioner 1 including an inverter circuit cooling portion (a control unit cooling portion) 16 capable of cooling an inverter circuit C (a control unit) to inverter-control a compressor 5 using a refrigerant, and includes an indoor unit 2 and an outdoor unit 3 as shown in FIG. 1.

The indoor unit 2 includes an indoor heat exchanger 4, a room temperature sensor (not shown) capable of detecting a room temperature in a room, a remote (not shown), and the like.

The outdoor unit 3 includes a compressor 5, a four-way valve 6, an outdoor fan 7, an outdoor heat exchanger 8, an expansion valve 9, an outdoor air temperature sensor 10 capable of detecting an outdoor air temperature, an accumulator 11, and a control portion 12. The accumulator 11 serves to separate an introduced refrigerant into gas and liquid, and is disposed between the compressor 5 and the four-way valve 6. The control portion 12 may control a refrigerant discharge amount of the compressor 5, an opening degree of the expansion valve 9, and the like, based on information detected by each temperature sensor.

The air conditioner 1 includes a main refrigerant circuit 13 and an injection circuit 14. The main refrigerant circuit 13 is a circuit configured such that a refrigerant flows in order of the compressor 5, the outdoor heat exchanger 8, the expansion valve 9, and the indoor heat exchanger 4. The injection circuit 14 is a circuit configured such that a refrigerant diverges between the outdoor heat exchanger 8 and indoor heat exchanger 4 in the main refrigerant circuit 13 and returns to the compressor 5 in a state of having a pressure between a suction pressure and a discharge pressure.

The injection circuit 14 includes an injection pipe 18 (indicated by a thick line in FIG. 1) configured such that a refrigerant diverges between the outdoor heat exchanger 8 and indoor heat exchanger 4 and returns to the compressor 5. The injection circuit 14 includes an injection decompression valve 15, an inverter circuit cooling portion 16, and a sub-cooler evaporation portion 17 which are provided on the injection pipe 18. In other words, the inverter circuit cooling portion 16 is provided between the injection decompression valve 15 and the sub-cooler evaporation portion 17. Accordingly, a refrigerant in a substantial liquid state is introduced into the inverter circuit cooling portion 16 from an upstream side of the sub-cooler evaporation portion 17.

The injection decompression valve 15 is configured to adjust an opening degree thereof, thereby enabling the pressure of a refrigerant to be reduced. The inverter circuit cooling portion 16 is provided between the injection decompression valve 15 and the sub-cooler evaporation portion 17 in the injection circuit 14.

The inverter circuit cooling portion 16 includes a contact portion 16*a* coming into contact with the inverter circuit C and a cooling pipe 16*b* meandering inside the contact portion 16*a*. Accordingly, the inverter circuit cooling portion 16 may cool the inverter circuit C using a refrigerant flowing through the cooling pipe 16*b*.

The sub-cooler evaporation portion 17 is provided at a farther downstream side than the injection decompression valve 15 and the inverter circuit cooling portion 16. The sub-cooler evaporation portion 17 is configured such that heat exchange is performed between a refrigerant flowing through the injection pipe 18 and a refrigerant flowing through the main refrigerant circuit 13. In the sub-cooler evaporation portion 17, the refrigerant flowing through the injection pipe 18 evaporates by absorbing heat from the refrigerant flowing through the main refrigerant circuit 13. The refrigerant vaporized by evaporation returns to the compressor 5 in a state of having a pressure between a suction pressure and a discharge pressure.

[Regarding Flow of Refrigerant in Air Conditioner 1]

Hereinafter, an operation of the air conditioner 1 with respect to the flow of the refrigerant in the air conditioner 1 according to the present embodiment will be described with reference to the P-H (pressure-enthalpy) diagram shown in FIG. 2. In addition, although the air conditioner 1 may realize any one of a cooling operation and a heating operation by switching of the four-way valve 6, a description will be given herein of the flow of the refrigerant during the cooling operation.

Figure 2:
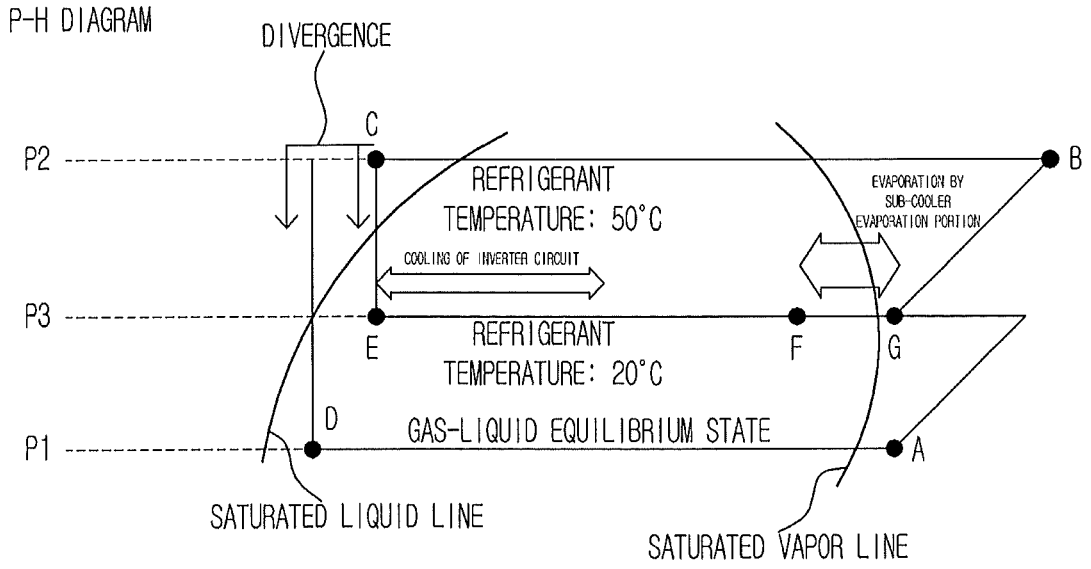
FIG. 2 is a diagram illustrating a refrigerant cycle in the air conditioner according to the first embodiment of the present disclosure.

First, the refrigerant is compressed in the compressor 5 until reaching a discharge pressure P2 via a pressure P3 (a pressure between a suction pressure P1 and a discharge pressure P2) from a suction pressure P1 in a state of being vaporized (A→G→B in FIG. 2). Then, the refrigerant discharged from the compressor 5 (the refrigerant temperature is 50° C. in this embodiment) passes though the four-way valve 6 and then flows through the outdoor heat exchanger 8. In this outdoor heat exchanger 8, the refrigerant is condensed and liquefied by radiating heat to outdoor air (B→C in FIG. 2). Subsequently, the liquefied refrigerant diverges between the outdoor heat exchanger 8 and the indoor heat exchanger 4, and a portion of the refrigerant is decompressed until reaching the suction pressure P1 from the discharge pressure P2 before being supplied to the indoor heat exchanger 4, thereby entering a gas-liquid equilibrium state (C→D in FIG. 2). Then, a portion of the refrigerant in the gas-liquid equilibrium state is supplied to the indoor heat exchanger 4. In this indoor heat exchanger 4, a portion of the refrigerant is evaporated and vaporized by absorbing heat from indoor air. Consequently, the indoor air is cooled. Then, a portion of the vaporized refrigerant is introduced to a suction side of the compressor 5 at the suction pressure P1 and is recompressed (D→A in FIG. 2).

Meanwhile, the refrigerant diverging from the downstream side of the outdoor heat exchanger 8 is decompressed in the injection decompression valve 15 until reaching the pressure P3 from the discharge pressure P2, thereby entering a gas-liquid equilibrium state rich in liquid (C→E in FIG. 2). The decompressed refrigerant rich in liquid (the refrigerant temperature is 20° C. in this embodiment) is supplied to the inverter circuit cooling portion 16. That is, in the inverter circuit cooling portion 16, the inverter circuit C is cooled using the refrigerant in a liquid-rich state. After cooling the inverter circuit C, the refrigerant is supplied to the sub-cooler evaporation portion 17 (part of E→F in FIG. 2). In this sub-cooler evaporation portion 17, the remaining refrigerant is evaporated by heat exchange. Then, the refrigerant, which has an intermediate pressure, vaporized by evaporation is reintroduced into the compressor 5 at the pressure P3 (F→G in FIG. 2).

Next, the present disclosure according to the embodiment will be described in detail with reference to FIG. 3. Herein, a description will be given of a result of consideration of utility of the air conditioner 1 according to the present embodiment, based on a relationship between an IPM (inverter power module) temperature (° C.) and a condensation temperature (° C.) in the condenser. In addition, the present disclosure is not limited to this embodiment. In more detail, the inventors have considered utility of the air conditioner 1 according to the present embodiment by comparing a cooling method of an IPM which cools the IPM (corresponding to the inverter circuit in the present embodiment) by providing the inverter circuit cooling portion 16 with respect to the injection circuit 14 according to the present embodiment, with a cooling method of an IPM using the conventional manner of providing the inverter cooling portion in the main refrigerant circuit.

Figure 3:
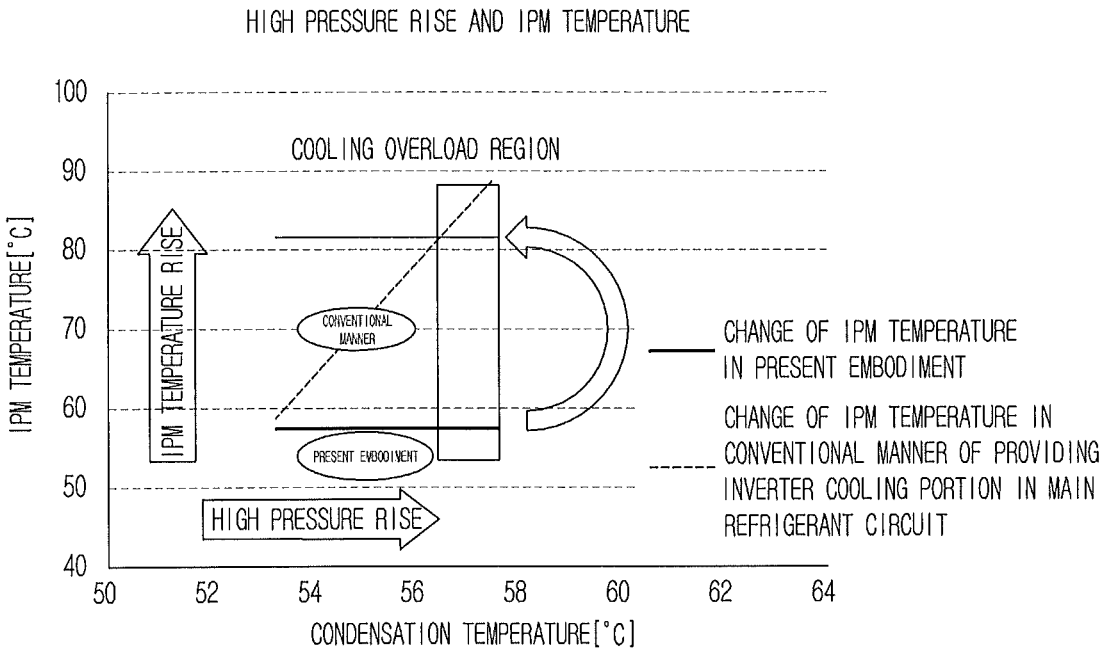
FIG. 3 is a diagram illustrating a relationship between an IPM temperature (° C.) and a condensation temperature (° C.)

FIG. 3 illustrates a relationship between the IPM temperature (° C.) and the condensation temperature (° C.) in the condenser. As shown in FIG. 3, in a manner of providing the inverter cooling portion in the conventional main refrigerant circuit, since the IPM temperature (° C.) is changed in proportion to a load condition (condensation temperature (° C.)), the IPM temperature may not be held at a uniform temperature (about 80° C. in the present embodiment). Therefore, in the conventional manner of providing the inverter cooling portion in the main refrigerant circuit, as the condensation temperature (° C.) drops, the IPM temperature (° C.) is lowered, and thus the IPM may be cooled to a temperature lower than the outdoor air temperature. In this case, as a result of the IPM being cooled to a temperature lower than the outdoor air temperature, dew condensation occurs on the IPM, thereby resulting in breakdown of the IPM.

Conventionally, in a condition of an outdoor air required for high cooing in which a load (condensation temperature) is increased, since the IPM temperature also rises depending upon an operation state, the IPM is severely cooled. Therefore, there is a need for a design according to characteristics of high pressure rise of the air conditioner. However, if the design is performed under a strict condition, dew condensation may occur on the IPM in a condition of a low load in which the condensation temperature is lowered.

In contrast, in the cooling method of the IPM using the injection circuit 14 according to the present embodiment, even when the load condition (condensation temperature (° C.)) is changed, the IPM temperature may be held at a stable temperature (about 80° C. in the present embodiment). Accordingly, in accordance with the present embodiment, it may be possible to prevent breakdown of the IPM caused by occurrence of dew condensation on the IPM due to the IPM temperature cooled to a temperature lower than the outdoor air temperature in the conventional manner of providing the inverter cooling portion in the main refrigerant circuit. In addition, a design is simple in the present embodiment, compared with the conventional manner of providing the inverter cooling portion in the main refrigerant circuit. Furthermore, by changing a cooling area in the inverter circuit cooling portion 16, the IPM temperature may be simply managed and at the same time may be simply designed within a dew condensation prevention temperature.

[Characteristics of Air Conditioner in First Embodiment]

In accordance with the above-mentioned configuration, since the inverter circuit cooling portion 16 is provided between the injection decompression valve 15 and the sub-cooler evaporation portion 17 in the injection circuit 14, the refrigerant in a liquid-rich state may be supplied through the injection decompression valve 15 to the inverter circuit cooling portion 16. Accordingly, in the inverter circuit cooling portion 16, the inverter circuit C may be cooled using the refrigerant in a liquid-rich state, which is not nearly vaporized. Thus, it may be possible to deprive the inverter circuit C of a maximum quantity of heat, and thus to improve cooling efficiency of the inverter circuit, compared with a case of cooling the inverter circuit C using the refrigerant in a vaporized state.

Accordingly, in accordance with the above-mentioned configuration, by cooling the inverter circuit C using the refrigerant in a liquid-rich state, it may be possible to deprive the inverter circuit C of substantial heat. Consequently, the refrigerant may be further vaporized than that of the related art by heat exchange in the sub-cooler evaporation portion 17 and be introduced into the compressor 5. Thus, in the above configuration, it may be possible to efficiently cool the inverter circuit C and to improve compression efficiency of the compressor 5.

In addition, in accordance with the above-mentioned configuration, the cooling efficiency of the inverter circuit C may be increased. Accordingly, required cooling efficiency may be obtained even when the inverter circuit cooling portion 16 is minimized and a heat radiation area is small, compared with the related art, thereby enabling the volume of the outdoor unit 3 to be minimized.

In addition, in the conventional manner of providing the inverter cooling portion in the main refrigerant circuit, when air conditioning is requested, air conditioning temperature control is preferentially performed. Therefore, it may not be possible to execute control for the main purpose of cooling the inverter circuit C and to be set as a refrigerant temperature suitable for cooling of the inverter circuit C. In contrast, in accordance with the above-mentioned configuration, since the inverter circuit cooling portion 16 is provided in the injection circuit 14, it may be possible to be set as a refrigerant temperature suitable for cooling of the inverter circuit C by refrigerant control in the injection circuit 14 without interruption of refrigerant control related to the air conditioning control which is the main purpose of the air conditioner 1.

In addition, in the conventional manner of providing the inverter cooling portion in the main refrigerant circuit, when the temperature of the inverter circuit C is equal to or less than a dew-point temperature, there is only a measure which substantially affects the basic performance of the product such as lowering frequency of the compressor, in order to prevent dew condensation generated on the inverter circuit C by increasing the temperature of the inverter circuit C. In contrast, in accordance with the above-mentioned configuration, since the inverter circuit cooling portion 16 is provided in the injection circuit 14, flow rate control of the refrigerant may be performed by the injection circuit 14 alone, independently of the main refrigerant circuit 13. Consequently, it may be possible to suppress deterioration of the basic performance of the product. For example, it may be possible to prevent the temperature of the inverter circuit C from being equal to or less than a dew-point temperature by realizing the flow rate control of the refrigerant using an opening and closing operation of the injection decompression valve 15.

Second Embodiment

Hereinafter, an air conditioner 1 according to a second embodiment of the present disclosure will be described with reference to FIGS. 4 and 5. In addition, components similar to those described in the first embodiment are designated by similar reference numerals, and no detailed description with respect to the similar components will be given. The second embodiment differs from the first embodiment in that the injection circuit 14 includes a throttle pipe 19.

[Configuration of Injection Circuit 14]

Figure 4:
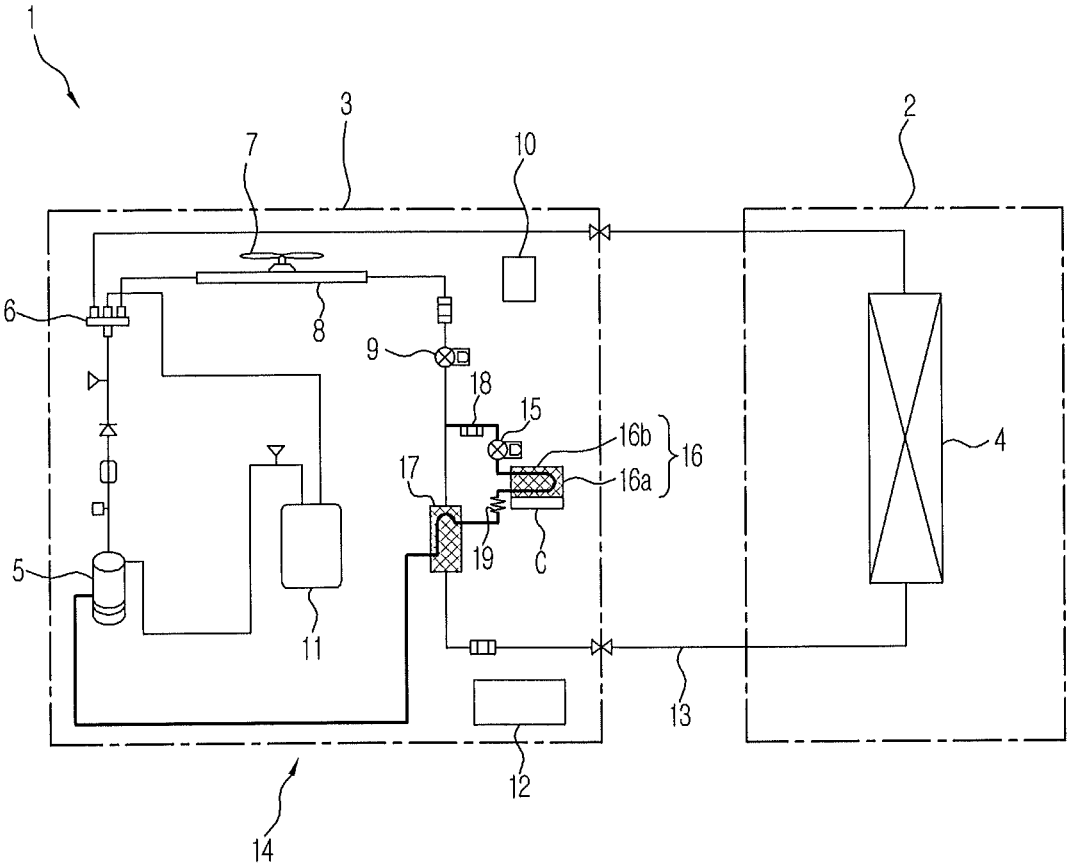
FIG. 4 is a diagram illustrating a configuration example of an air conditioner according to a second embodiment of the present disclosure.

As shown in FIG. 4, the injection circuit 14 includes the injection pipe 18 (indicated by a thick line in FIG. 4) configured such that the refrigerant diverges between the outdoor heat exchanger 8 and indoor heat exchanger 4 and returns to the compressor 5. The injection circuit 14 includes the injection decompression valve 15, the inverter circuit cooling portion 16, the sub-cooler evaporation portion 17, and the throttle pipe 19 which are provided on the injection pipe 18. The throttle pipe 19 is provided between the inverter circuit cooling portion 16 and the sub-cooler evaporation portion 17.

[Regarding Flow of Refrigerant in Air Conditioner 1]

Hereinafter, an operation of the air conditioner 1 with respect to the flow of the refrigerant in the air conditioner 1 according to the present embodiment will be described with reference to the P-H (pressure-enthalpy) diagram shown in FIG. 5. In addition, although the air conditioner 1 may realize any one of a cooling operation and a heating operation by switching of the four-way valve 6, a description will be given herein of the flow of the refrigerant during the cooling operation. Herein, an opening degree of the expansion valve 9 is a fully opened state.

Figure 5:
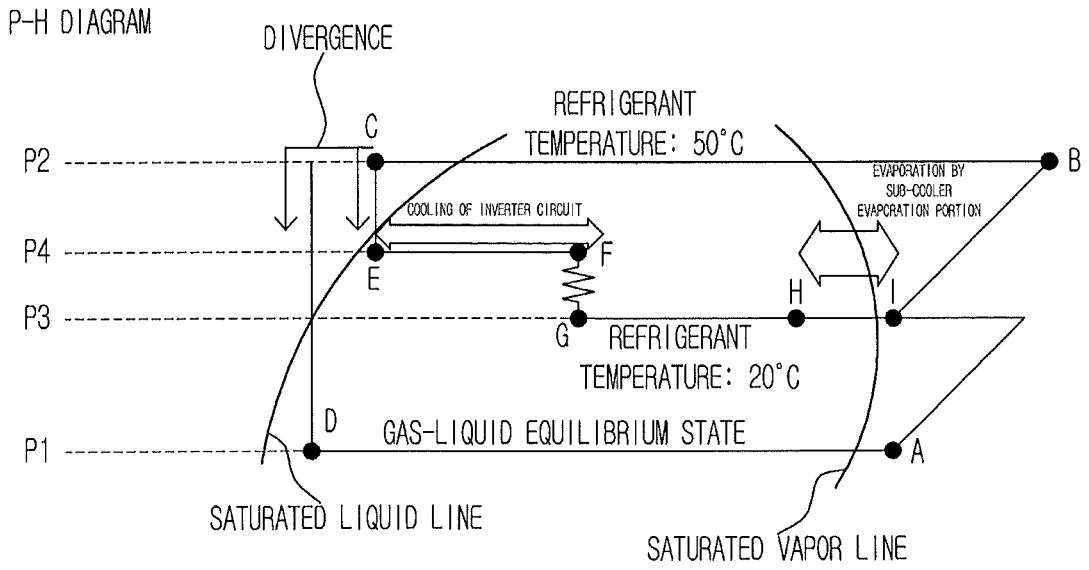
FIG. 5 is a diagram illustrating a refrigerant cycle in the air conditioner according to the second embodiment of the present disclosure.

The refrigerant diverging between the outdoor heat exchanger 8 and the indoor heat exchanger 4 is decompressed in the injection decompression valve 15 until reaching a pressure P4 from the discharge pressure P2, thereby entering a gas-liquid equilibrium state rich in liquid (C→E in FIG. 5). Then, the decompressed refrigerant rich in liquid is supplied to the inverter circuit cooling portion 16. In this inverter circuit cooling portion 16, the inverter circuit C is cooled using the refrigerant in a liquid-rich state (20° C.<refrigerant temperature<50° C. in this embodiment) (E→F in FIG. 5). After this cooling, the refrigerant is supplied to the throttle pipe 19. In this throttle pipe 19, the refrigerant is decompressed until reaching the pressure P3 from the pressure P4 (F→G in FIG. 5). Then, the decompressed refrigerant (the refrigerant temperature is 20° C. in this embodiment) is supplied to the sub-cooler evaporation portion 17 (G→H in FIG. 5). In this sub-cooler evaporation portion 17, the refrigerant is evaporated by heat exchange. Then, the refrigerant vaporized by evaporation is reintroduced into the compressor 5 at the pressure P3 (H→I in FIG. 5).

[Characteristics of Air Conditioner in Second Embodiment]

In accordance with the above-mentioned configuration, it may be possible to obtain the same effect as the air conditioner 1 according to the first embodiment.

In addition, in accordance with the above-mentioned configuration, since the injection circuit 14 further includes the throttle pipe 19 provided between the inverter circuit cooling portion 16 and the sub-cooler evaporation portion 17, the refrigerant temperature in the inverter circuit cooling portion 16 (20° C.<refrigerant temperature<50° C. in this embodiment) may be freely adjusted by suitably adjusting design parameters such as a diameter of the throttle pipe 19.

Third Embodiment

Hereinafter, an air conditioner 1 according to a third embodiment of the present disclosure will be described with reference to FIGS. 6 and 7. In addition, components similar to those described in the first embodiment are designated by similar reference numerals, and no detailed description with respect to the similar components will be given. The third embodiment differs from the first embodiment in that the control portion 12 includes an inverter circuit temperature detection portion (control unit temperature detection portion) 20, a dew-point temperature calculation portion 21, and an opening degree adjustment portion 22.

[Configuration of Control Portion 12]

Figure 6:
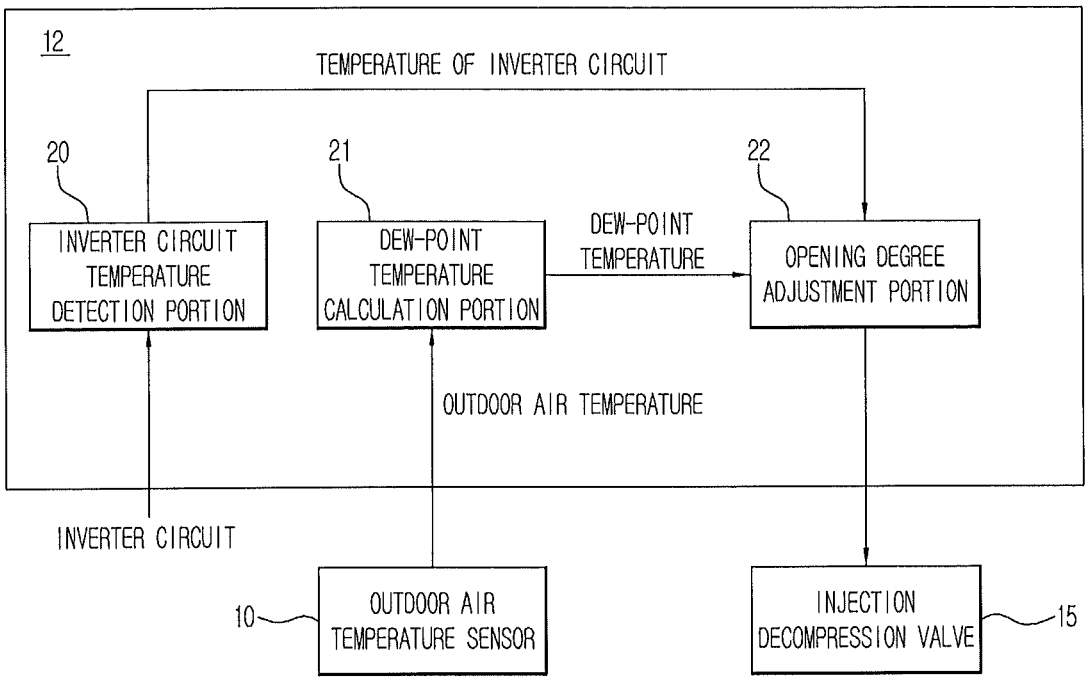
FIG. 6 a block diagram illustrating a configuration of a control portion according to a third embodiment of the present disclosure.
Figure 7:
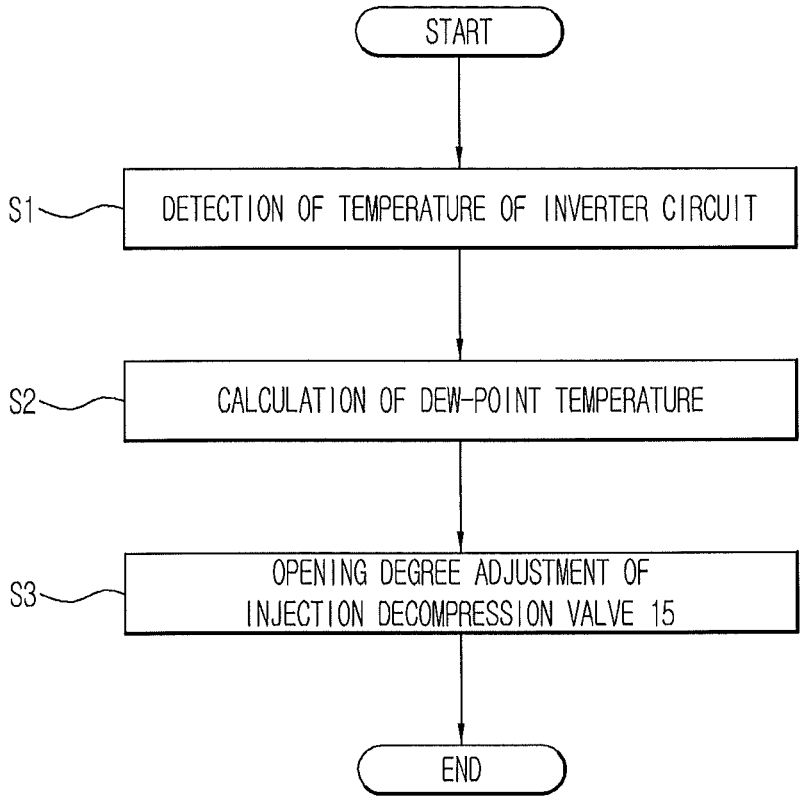
FIG. 7 is a flowchart illustrating an example of a dew condensation prevention control operation according to the third embodiment of the present disclosure.

FIG. 6 a block diagram illustrating a configuration of the control portion 12 according to the third embodiment of the present disclosure. As shown in FIG. 6, the control portion 12 includes the inverter circuit temperature detection portion 20, the dew-point temperature calculation portion 21, and the opening degree adjustment portion 22. The inverter circuit temperature detection portion 20 may detect a temperature of the inverter circuit (control unit). The dew-point temperature calculation portion 21 may calculate a dew-point temperature at which dew condensation is generated on the inverter circuit C, based on the outdoor air temperature detected by the outdoor air temperature sensor 10. The opening degree adjustment portion 22 may adjust an opening degree of the injection decompression valve 15 such that the temperature of the inverter circuit C is equal to or more than the dew-point temperature.

[Dew Condensation Prevention Control Operation of Inverter Circuit C in this Embodiment]

Hereinafter, a dew condensation prevention control operation of the inverter circuit C in this embodiment will be described with reference to FIG. 7. FIG. 7 is a flowchart illustrating an example of the dew condensation prevention control operation according to the present embodiment. Each operation shown in FIG. 7 may be realized by executing programs stored in a ROM by the control portion 12.

First, at step S1, the inverter circuit temperature detection portion 20 detects a temperature of the inverter circuit C. Then, the process proceeds to step S2.

Next, at step S2, the dew-point temperature calculation portion 21 calculates a dew-point temperature at which dew condensation is generated on the inverter circuit C, based on the outdoor air temperature detected by the outdoor air temperature sensor 10. Then, the process proceeds to step S3.

Finally, at step S3, the opening degree adjustment portion 22 adjusts an opening degree of the injection decompression valve 15 such that the temperature of the inverter circuit C is equal to or more than the dew-point temperature. Consequently, the dew condensation prevention control operation of the inverter circuit C in this embodiment is completed.

[Characteristics of Air Conditioner in Third Embodiment]

In accordance with the above-mentioned configuration, it may be possible to obtain the same effect as the air conditioner 1 according to the first embodiment.

In addition, in accordance with the above-mentioned configuration, since the opening degree adjustment portion 22 adjusts an opening degree of the injection decompression valve 15 such that the temperature of the inverter circuit C is equal to or more than the dew-point temperature, it may be possible to prevent the temperature of the inverter circuit C from falling below the dew-point temperature and to securely prevent breakdown of the inverter circuit C caused by generation of dew condensation on the inverter circuit C.

Although the embodiments of the present disclosure have been described with reference to the drawings, a specific configuration is not limited thereto. It would be appreciated by those skilled in the art that changes may be made in these embodiments without departing from the principles and spirit of the invention, the scope of which is defined in the claims and their equivalents.

In addition, although each embodiment has described an example of cooling the inverter circuit, as an example of the control unit, to inverter-control the compressor using the inverter circuit cooling portion of the injection circuit, the present disclosure is not limited thereto. For example, in addition to the inverter circuit, a variety of control units to control the compressor may also be cooled using a control unit cooling portion of the injection circuit.

In addition, although the third embodiment has described an example in which the dew-point temperature calculation portion 21 calculates a dew-point temperature at which dew condensation is generated on the inverter circuit C, based on the outdoor air temperature detected by the outdoor air temperature sensor 10, the present disclosure is not limited thereto. For example, the dew-point temperature calculation portion 21 may calculate a dew-point temperature at which dew condensation is generated on the inverter circuit, based on the outdoor air temperature and humidity. Consequently, the dew-point temperature may be accurately calculated, compared with a case of calculating the dew-point temperature, based on the outdoor air temperature alone.

In addition, although each embodiment has described an example of applying the present disclosure to cooling of the inverter circuit, the present disclosure may be applied to a case in which the cooling is required for the control unit to control the compressor, in addition to the inverter circuit.

As is apparent from the above description, in accordance with the air conditioner according to the present disclosure, since the control unit cooling portion is provided between the injection decompression valve and the sub-cooler evaporation portion in the injection circuit, the refrigerant in a liquid-rich state may be supplied through the injection decompression valve to the control unit cooling portion. Consequently, the control unit may be cooled using the refrigerant in a liquid-rich state which is not so much vaporized in the control unit cooling portion. Accordingly, compared with a case of cooling the control unit using the refrigerant in a vaporized state, it may be possible to deprive the control unit of a maximum quantity of heat per unit time, and thus to efficiently cool the control unit.

In addition, in accordance with the air conditioner according to the present disclosure, by cooling the control unit using the refrigerant in a liquid-rich state, it may be possible to deprive the control unit of much heat. Consequently, the refrigerant may be farther vaporized than that of the related art by heat exchange in the sub-cooler evaporation portion. Accordingly, the refrigerant may be introduced into the compressor in a farther vaporized state than the related art. Thus, it may be possible to efficiently cool the control unit and to improve compression efficiency of the compressor.

Furthermore, in accordance with the air conditioner according to the present disclosure, the cooling efficiency of the control unit may be increased, and thus required cooling efficiency may be obtained even when the control unit cooling portion is minimized and a heat radiation area is small, compared with the related art, thereby enabling the volume of the outdoor unit to be minimized.

Although a few embodiments of the present disclosure have been shown and described, it would be appreciated by those skilled in the art that changes may be made in these embodiments without departing from the principles and spirit of the disclosure, the scope of which is defined in the claims and their equivalents.

REFERENCE NUMERALS

1: air conditioner
2: indoor unit
3: outdoor unit
4: indoor heat exchanger
5: compressor
6: four-way valve
7: outdoor fan
8: outdoor heat exchanger
9: expansion valve
10: outdoor air temperature sensor
11: accumulator
12: control portion
13: inverter refrigerant circuit
14: injection circuit
15: injection decompression valve
16: inverter circuit cooling portion (control unit cooling portion)
17: sub-cooler evaporation portion
18: injection pipe
19: throttle pipe

20: inverter circuit temperature detection portion (control unit temperature detection portion)

21: dew-point temperature calculation portion

22: opening degree adjustment portion

What is claimed is:

1. An air conditioner comprising:

a main refrigerant circuit configured such that a refrigerant flows in order of a compressor, an outdoor heat exchanger, an expansion valve, and an indoor heat exchanger;

a control unit to control the compressor; and an injection circuit configured to diverge some of the refrigerant between the outdoor heat exchanger and indoor heat exchanger in the main refrigerant circuit and return the diverged refrigerant to the compressor in a state of having a pressure between a suction pressure of compressor and a discharge pressure of compressor, wherein the injection circuit comprises an injection decompression valve reducing a pressure of the diverged refrigerant;

a control unit cooling portion to cool the control unit using the diverged refrigerant; and a sub-cooler evaporation portion located at a downstream side of the injection decompression valve to perform heat exchange between the diverged refrigerant and a remainder of the refrigerant between the outdoor heat exchanger and indoor heat exchanger in the main refrigerant circuit, and wherein the control unit cooling portion is provided between the injection decompression valve and the sub-cooler evaporation portion in the injection circuit, and wherein the injection circuit is configured to diverge some of the refrigerant between the expansion valve and the sub-cooler evaporation portion.

2. The air conditioner according to claim 1, wherein the injection circuit further comprises a throttle pipe provided between the control unit cooling portion and the sub-cooler evaporation portion.

3. The air conditioner according to claim 1, further comprising:

an outdoor air temperature sensor capable of detecting an outdoor air temperature;

a control unit temperature detection portion capable of detecting a temperature of the control unit;

a dew-point temperature calculation portion calculating a dew-point temperature at which dew condensation is generated on the control unit, based on the outdoor air temperature; and an opening degree adjustment portion adjusting an opening degree of the injection decompression valve such that the temperature of the control unit is equal to or more than the dew-point temperature.

4. An air conditioner system comprising:

a main refrigerant circuit comprising a compressor to compress a refrigerant, a control unit to control the compressor, an outdoor heat exchanger, an expansion valve, and an indoor heat exchanger; and an injection circuit configured to diverge some of the refrigerant between the outdoor heat exchanger and indoor heat exchanger in the main refrigerant circuit and return the diverged refrigerant to the compressor, the injection circuit comprising an injection decompression valve reducing a pressure of the diverged refrigerant, a control unit cooling portion to cool the control unit, a sub-cooler evaporation portion located at a downstream side of the injection decompression valve to perform heat exchange between the diverged refrigerant and a remainder of the refrigerant between the outdoor heat exchanger and indoor heat exchanger in the main refrigerant circuit, wherein the control unit cooling portion is provided between the injection decompression valve and the sub-cooler evaporation portion in the injection circuit, and wherein the infection circuit is configured to diverge some of the refrigerant between the expansion valve and the sub-cooler evaporation portion.

5. The air conditioner system according to claim 4, further comprising a throttle pipe provided between the control unit cooling portion and the sub-cooler evaporation portion.

6. The air conditioner system according to claim 4, further comprising:

an outdoor air temperature sensor;

a control unit temperature detection sensor;

a dew-point temperature calculation portion to calculate a dew-point temperature at which dew condensation is generated on the control unit, based on the outdoor air temperature; and an opening degree adjustment portion configured to adjust an opening degree of the injection decompression valve such that the temperature of the control unit is equal to or more than the dew-point temperature.

* * * * *